US007077914B2

(12) United States Patent
Tennyson, Sr.

(10) Patent No.: US 7,077,914 B2
(45) Date of Patent: Jul. 18, 2006

(54) RIGID PAINT SCRAPER WITH FLEXIBLE BENDS

(75) Inventor: Larry Tennyson, Sr., 1218 N. Arbor Bough Cir., Fresno, TX (US) 77545

(73) Assignee: Larry Tennyson, Sr., Fresco, TX (US)

( * ) Notice: Subject to any disclaimer, the term of this patent is extended or adjusted under 35 U.S.C. 154(b) by 434 days.

(21) Appl. No.: 10/387,183

(22) Filed: Mar. 12, 2003

(65) Prior Publication Data

US 2004/0177862 A1 Sep. 16, 2004

(51) Int. Cl.
*A47L 13/02* (2006.01)
*A47L 13/08* (2006.01)

(52) U.S. Cl. ..... 134/6; 15/236.06; 15/245.1; 15/236.08; 30/169

(58) Field of Classification Search ..... 15/236.01, 15/236.05–236.09, 245.1, 235.3, 235.6; 30/169, 30/172; D32/46, 48, 49; 134/6
See application file for complete search history.

(56) References Cited

U.S. PATENT DOCUMENTS

| | | | | | |
|---|---|---|---|---|---|
| 614,810 | A * | 11/1898 | Houghton | 30/169 |
| 1,498,509 | A * | 6/1924 | Arnold | 416/71 |
| 1,720,630 | A * | 7/1929 | Eiermann | 15/245 |
| 3,119,138 | A * | 1/1964 | Davis | 15/245.1 |
| 4,200,948 | A * | 5/1980 | Nesseth | 15/236.08 |
| 6,163,919 | A | 12/2000 | Mitchell | |
| 6,308,370 | B1 * | 10/2001 | Southby | 15/245.1 |
| 6,311,362 | B1 | 11/2001 | Arbogast | |
| 6,351,888 | B1 | 3/2002 | Brown et al. | |

* cited by examiner

*Primary Examiner*—Mark Spisich
*Assistant Examiner*—Shay Balsis
(74) *Attorney, Agent, or Firm*—Norma N. Bennett; Shook, Hardy & Bacon, L.L.P.

(57) ABSTRACT

The present invention is directed to a scraper suitable for use in removing material adhering to flat surfaces, e.g. paint. In the presently preferred embodiment, the scraper comprises a blade body, a scraping surface and a handle. The scraping surface extends longitudinally along a bottom edge of the blade body while the handle is affixed to a top edge of the blade body. The blade body comprises an elongate, flat body constructed of a rigid, yet flexible material, e.g. steel. The blade is characterized by a pair of angular bends dividing the blade into a center portion and two end portions, each portion being in a different plane. The bends are preferably positioned on opposite sides of the handle, more preferably equidistant from each end of the blade body. The end portions are angled to opposite sides of the center portion so that the angles are complementary, resulting in the end portions being generally parallel. The angles between the center portion and each end portion are preferably obtuse, more preferably being about 135 degrees. Flexure of the blade at the angular bends as the scraper is moved across a flat surface improves the surface cleaning and paint removal action of the scraper. In the presently preferred embodiment, the scraping surface further includes a plurality of teeth projecting outwardly from the blade body. The flexible bends in the blade allow the scraping force applied through the handle to be evenly distributed along the entire scraping surface, thus facilitating efficient and quick removal of paint across a large surface area.

13 Claims, 2 Drawing Sheets

RIGID PAINT SCRAPER WITH FLEXIBLE BENDS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

The present invention generally relates to a hand held scraper for removing material from surfaces. More particularly, the present invention relates to a hand held paint scraper for removing paint from flat surfaces, particularly the walls and eaves of houses and similar structures.

2. Description of the Related Art

The use of scrapers, especially for the removal of paint, is well known in the prior art. Nonetheless, those skilled in the art have continued to seek improved devices for removing paint from surfaces. Some of the disadvantages associated with prior art scrapers are that they can damage the underlying surface with prolonged use, do not remove paint quickly and efficiently, and require excessive physical effort on the part of the operator.

Prior art scrapers have attempted unsuccessfully to remedy some of these disadvantages. For example, a prior art scraper found at U.S. Pat. No. 6,163,919 includes a forearm support section as part of its configuration. The operator rests his or her wrist on the forearm support thereby reducing stress on the operator's wrist. However, although this scraper reduces operator fatigue, it does not improve the speed and efficiency at which paint is removed from a surface, nor does it prevent undue damage to the underlying surface.

Thus, there continues to be a long felt but unfulfilled need for improved and more efficient devices for removing paint from surfaces. The present invention solves those needs by providing a scraper that will cover a greater surface area with each stroke of the scraper across a surface, thus removing paint more quickly and efficiently and minimizing operator time and effort.

SUMMARY OF THE INVENTION

The present invention is directed to an improved hand held scraper for removing material from flat surfaces. The improved scraper facilitates the removal of paint from various flat surfaces, particularly the eaves and walls of structures. The improved scraper removes paint from surfaces much more quickly and efficiently than existing devices by removing paint from a larger surface area per stroke than that of prior art scrapers.

The scraper consists of a blade body, a scraping surface, and an attached handle. The blade body is an elongate, flat body constructed of a rigid, yet flexible material. The blade body consists of a pair of angular bends dividing the blade into a center portion, a top edge, a bottom edge and two end portions, each end portion being in a different plane. The angular bends in the blade facilitate quick and efficient removal of paint from surfaces, by allowing the removal of paint in different directions simultaneously. The scraping surface extends longitudinally along the bottom edge of the blade body and consists of teeth integrally attached to the scraping surface. In an alternate embodiment, the scraping surface terminates in a sharp, beveled edge, instead of integrally attached teeth. The handle is affixed to the blade body.

In using the present invention to remove paint from a surface, the scraper is applied to the surface. The handle is grasped by the operator and the operator's hand applies downward and lateral forces to the handle. As the downward and lateral forces are applied to the handle, the operator moves the blade body laterally across the surface, causing the teeth of the scraping surface to engage the painted surface. As the teeth connect with the painted surface, and the blade body is moved along the painted surface, the flexible blade body bends at each of the angular bends and rapidly removes the paint. It is the shape of the bends that allow the scraping force applied by the operator to be evenly distributed across the painted surface. The teeth are of a sufficient length to remove paint without damaging the surface beneath. In an alternate embodiment, the scraping surface is not comprised of teeth but instead is comprised of a sharp beveled edge which contacts the surface and removes the paint.

Thus, the long felt, but unfulfilled need for rapid removal of paint from a surface using an improved device has been met. These and other meritorious features and advantages of the present invention will be more fully appreciated from the following description and claims.

BRIEF DESCRIPTION OF THE DRAWINGS

Other features and intended advantages of the present invention will be more readily apparent by reference to the following detailed description in connection with the accompanying drawings wherein.

While the invention will be described in connection with the presently preferred embodiment, it will be understood that this is not intended to limit the invention to that embodiment. To the contrary, it is intended to cover all alternatives, modifications and equivalents as may be included in the spirit of the invention as defined in the appended claims.

DETAILED DESCRIPTION OF INVENTION

Figure 1:
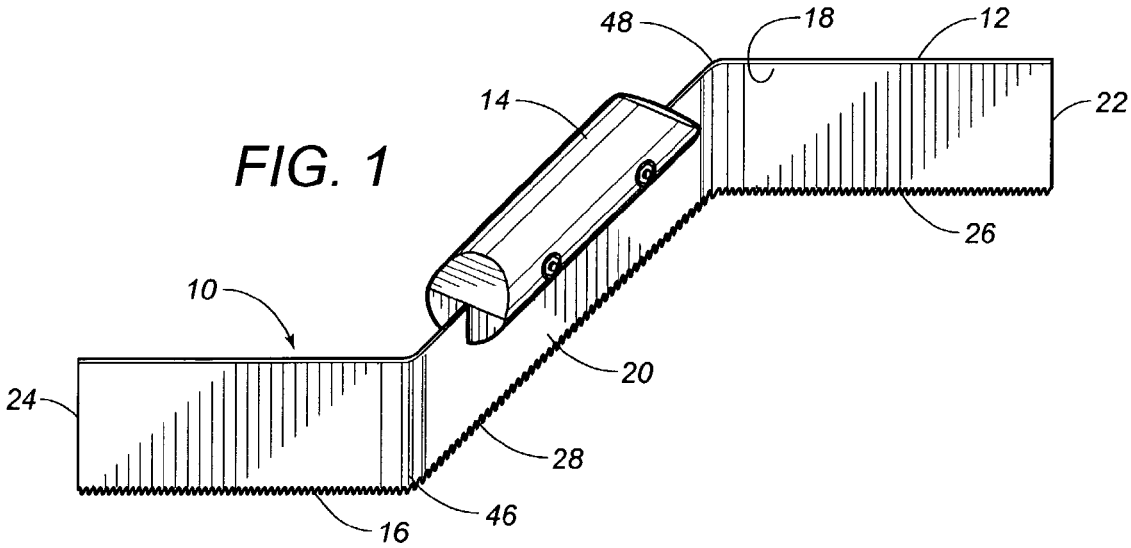
FIG. 1 is a perspective view of the preferred embodiment of the scraper of the present invention.
Figure 2:
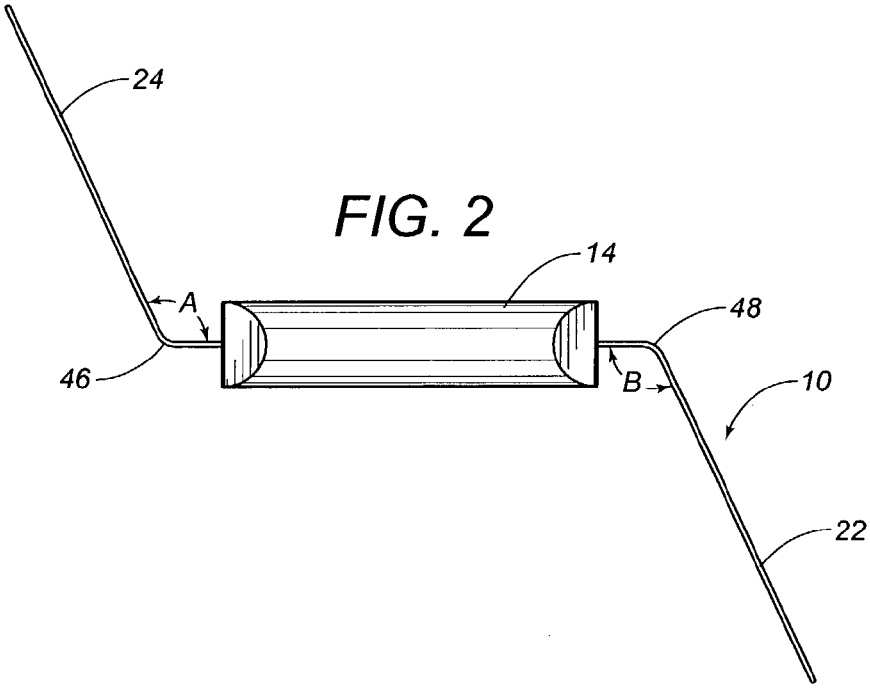
FIG. 2 is a view of the top of the preferred embodiment of the scraper of the present invention as illustrated in FIG. 1.
Figure 3:
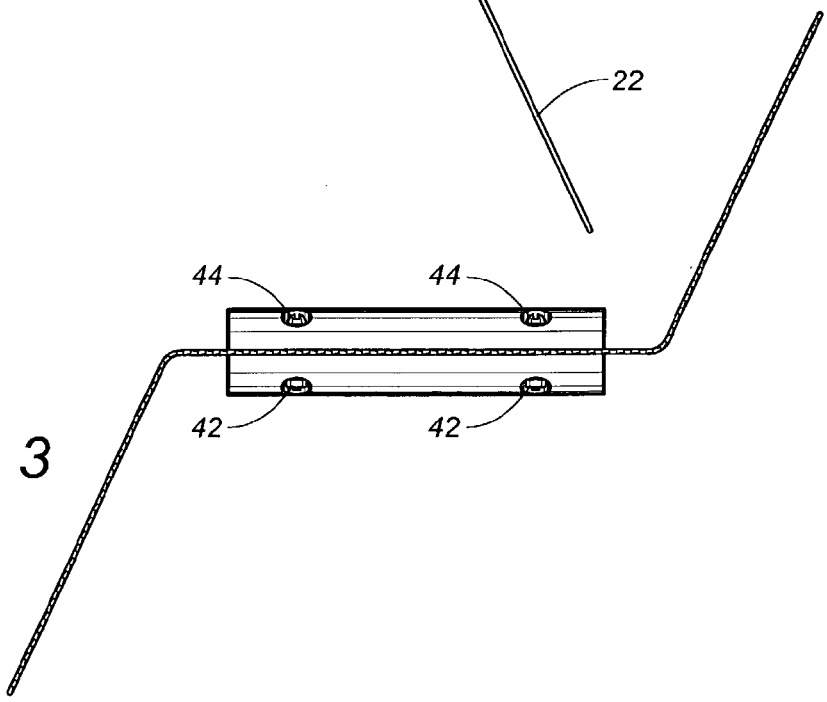
FIG. 3 is an view of the bottom of the preferred embodiment of the scraper of the present invention as illustrated in FIG. 1.
Figure 4A:
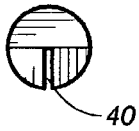
FIG. 4*a* is a end view of a handle for use with the scraper of FIG. 1.
Figure 4:
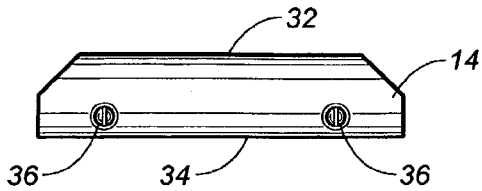
FIG. 4 is a side view of a handle for use with the scraper of FIG. 1.
Figure 5:
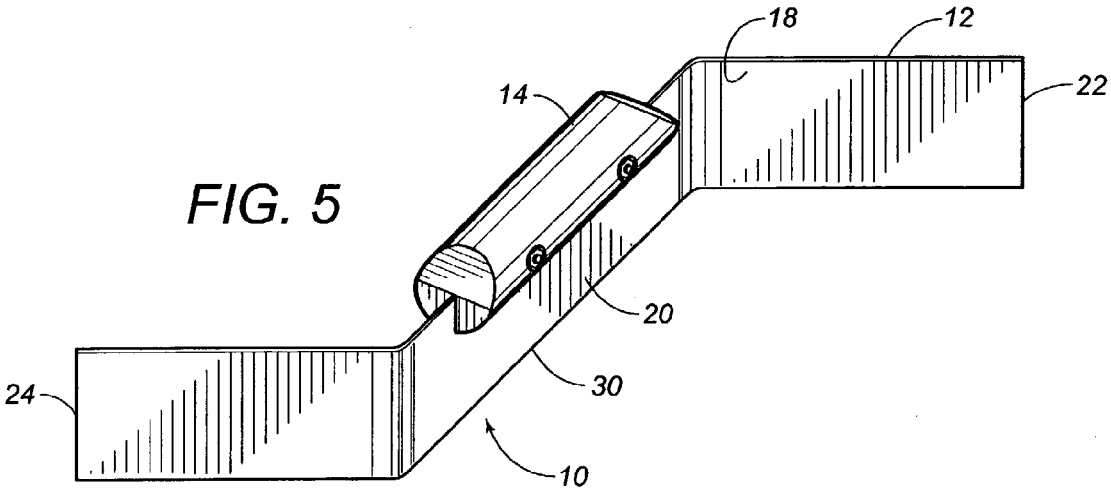
FIG. 5 is a perspective view of an alternate embodiment of the scraper of the present invention illustrating a scraping surface without projecting teeth.

The present invention provides a scraper. The scraper is designed for removing material from surfaces, e.g. paint, from flat surfaces. FIGS. 1–3 show the preferred embodiment. FIGS. 4 and 4*a* show a handle for use with the scraper. FIG. 5 shows an alternate embodiment. As illustrated in FIGS. 1 through 5, the scraper 10 generally comprises a blade body 12, a handle 14, and a scraping surface 16. The blade body 12 comprises an elongate, flat body constructed of a rigid, yet flexible material, such as spring steel or plastic, and includes a top edge 18, a center portion 20, two end portions 22, 24 and a bottom edge 26. The end portions 22, 24 are angled at angular bends 46, 48 to opposite sides of the center portion 20 resulting in angles A & B. Angles A & B are complementary, resulting in the end portions 22, 24 being generally parallel. Angles A & B are preferably positioned on opposite sides of the handle 14, and most preferably positioned equidistant from each end portion 22, 24 of the blade body 12 between the center portion 18 and each end portion 22, 24. Angles A & B are preferably greater than 90 degrees up and down from the center portion, more preferably between 100–150 degrees up and down from the center portion and most preferably at angles of about 135 degrees up and down from the center portion.

The scraping surface 16 extends longitudinally along a bottom edge 26 of the blade body 12. In the presently preferred embodiment, the scraping surface 16 comprises a plurality of teeth 28 which project outwardly from the blade body 12. In an alternative embodiment, illustrated in FIG. 5, the scraping surface 16 comprises a sharp beveled bottom edge 30, instead of a plurality of teeth 28.

The handle 14 comprises a top end 32 a bottom end 34, a pair of two holes 36 for attaching the handle 14 to the blade body 12, and a slot 40 for receiving the blade body 12. Two nuts 42 will pass through holes 36 of the handle 14 and are affixed to the handle 14 to the blade body 12 by attaching and tightening bolts 44 to nuts 42. Alternate embodiments will be apparent to those skilled in the art in which the handle 14 is affixed to the blade body 12 through various methods, such as by gluing.

In using the present invention to remove paint from a surface, the handle 14 is grasped by the operator and the scraper 10 is placed in contact with the flat surface. The operator then applies a downward and lateral force to the handle 14. As operator applies the downward and lateral force, the scraper 10 is moved laterally across the surface. As the scraper is moved laterally across the flat surface, the teeth 28 of the scraping surface 16 connect with the surface and removes the paint. When using the alternate embodiment, it is the sharp bottom beveled edge 30 which contacts the surface and removes the paint.

This new scraper 10 allows for removal of paint from a larger surface area with each pass of the scraper 10 over the surface than do the scrapers of the prior art. Because the blade body is bent at angular bends 46, 48, the scraper 10 removes paint in directions other than the direction of the movement of the scraper 10. This multidirectional scraping removes paint across a larger surface area per each stroke of the scraper 10 as compared to other prior art scrapers. For example, when the scraper 10 is placed such that the handle 14 is parallel to the surface of a wall, the entire blade body 12 comes in contact with the wall's surface. As the scraper 10 is moved in a direction perpendicular to the wall's surface, the center portion 20 of the scraper 10 directly beneath the handle 14 removes paint from the wall in the perpendicular direction. As the scraper 10 is moved across the surface, the blade body 12 flexes slightly at the angular bends 46, 48. The slight flexure of the blade body 12 at the angular bends 46, 48 as the scraper 10 is moved across a flat surface allows for the removal of paint in directions other than that of the movement of the scraper 10 and also allows the scraping force applied by the operator through the handle 14 to be applied evenly along the entire scraping surface 16. This even distribution of force permits the operator to exert less effort in operating the device than with prior art scrapers, reducing operator fatigue and facilitating quick and efficient removal of paint across a large surface area.

The foregoing description has been directed in primary part to a particular preferred embodiment in accord with the requirements of the Patent Statute and for purposes of explanation and illustration. It will be apparent, however, to those skilled in the art that many modifications and changes in the specifically described apparatus and methods may be made without departing from the true scope and spirit of the invention.

Therefore, the invention is not restricted to the preferred embodiment described and illustrated but covers all modifications which may fall within the scope of the following claims.

The invention claimed is:

1. A scraper for use in scraping material from a surface said scraper comprising:

a blade body with a top edge, and a bottom edge comprising an elongate, flat body constructed of a rigid, yet flexible material, said blade body characterized by a pair of angular bends forming a center portion and two end portions that are substantially parallel to one another, wherein said angular bends form obtuse angles on opposite sides of said center portion;

a scraping surface extending longitudinally along the blade body, wherein said scraping surface comprises a plurality of teeth projecting outwardly from said bottom edge along said center portion and each of said two end portions; and a handle positioned along to the top edge of said blade body.

2. The scraper of claim 1 wherein said angular bends form angles about 120–130 degrees upward and downward from the center portion.

3. The scraper of claim 1 wherein said end portions are angled to opposite sides of said handle such that said end portions are generally parallel.

4. The scraper of claim 1 wherein said angular bends of said blade body are positioned on opposite sides of said handle.

5. The scraper of claim 1 wherein said angular bends of said blade body are positioned equidistant from each end portion of said blade body.

6. The scraper of claim 1 wherein each of said teeth project outwardly from said scraping surface about 0.015–0.030 inches.

7. A scraper suitable for scraping paint from a surface comprising:

a handle;

a blade affixed to said handle, said blade having a top edge, a bottom edge, a center portion and two end portions, wherein said blade is characterized by a pair of angular bends forming obtuse angles on opposite sides of said center portion, wherein said two end portions are substantially parallel to each other; and a scraping surface extending longitudinally along the bottom of said blade and comprising a plurality of teeth projecting outwardly from said blade.

8. The scraper of claim 7 wherein said blade comprises an elongate, flat body constructed of a rigid material capable of flexing at the angular bends.

9. The scraper of claim 7 wherein said handle is positioned centered to the top of said blade.

10. The scraper of claim 7 wherein said angular bends of said blade are positioned on opposite sides of said handle.

11. The scraper device of claim 7 wherein said handle is affixed to the top of said blade at a point equidistant from each of said ends of said blade.

12. The scraper of claim 7 wherein each of said teeth project outwardly from said scraping surface about 0.015–0.030 inches.

13. A method for scraping paint from a surface comprising;

contacting a surface with a scraper comprising a blade body, said blade body characterized by a pair of angular bends forming obtuse angles between a center portion and two end portions, a scraping surface extending longitudinally along a first edge of said blade body, and a handle affixed to an opposite edge of said blade body, wherein said scraping surface comprises a plurality of teeth projecting outwardly along said center portion and each of said end portions;

grasping said handle;

placing in contact with said surface at least a portion of said plurality of teeth projecting outwardly from said two end portions;

applying a force to said handle; and moving said scraper in at least one of longitudinal, transverse, and circular directions to remove dried paint from said surface.

* * * * *